US007415096B2

(12) United States Patent
Sherman

(10) Patent No.: US 7,415,096 B2
(45) Date of Patent: Aug. 19, 2008

(54) CURVED X-RAY REFLECTOR

(75) Inventor: Dov Sherman, Pardesiyya (IL)

(73) Assignee: Jordan Valley Semiconductors Ltd., Migdal Ha'emek (IL)

( * ) Notice: Subject to any disclaimer, the term of this patent is extended or adjusted under 35 U.S.C. 154(b) by 76 days.

(21) Appl. No.: 11/491,962

(22) Filed: Jul. 25, 2006

(65) Prior Publication Data

US 2007/0025511 A1 Feb. 1, 2007

Related U.S. Application Data

(60) Provisional application No. 60/702,783, filed on Jul. 26, 2005.

(51) Int. Cl.
*G21K 1/06* (2006.01)

(52) U.S. Cl. ..... 378/84; 378/70

(58) Field of Classification Search ..... 378/84–85, 378/70, 71

See application file for complete search history.

(56) References Cited

U.S. PATENT DOCUMENTS

| | | | | |
|---|---|---|---|---|
| 4,780,899 | A | 10/1988 | Adema et al. | |
| 4,807,268 | A | 2/1989 | Wittry | |
| 4,949,367 | A | 8/1990 | Huizing et al. | |
| 6,029,337 | A | 2/2000 | Mehregany et al. | |
| 6,226,349 | B1 * | 5/2001 | Schuster et al. | 378/84 |
| 6,236,710 | B1 | 5/2001 | Wittry | |
| 6,360,424 | B1 | 3/2002 | Mehregany et al. | |
| 6,498,830 | B2 | 12/2002 | Wittry | |
| 6,522,716 | B1 * | 2/2003 | Murakami et al. | 378/34 |
| 7,119,953 | B2 * | 10/2006 | Yun et al. | 359/385 |
| 2003/0128811 | A1 * | 7/2003 | Verman et al. | 378/84 |

FOREIGN PATENT DOCUMENTS

| | | |
|---|---|---|
| EP | 0 732 624 | 9/1996 |
| WO | WO 96/34274 | 10/1996 |

OTHER PUBLICATIONS

Hoffman, et al., "Internal Stresses in Cr, Mo, Ta, and Pt Films Deposited by Sputtering from a Planar Magnetron Source", Journal of Vacuum Science and Technology 20:3, Mar. 1982, pp. 355-358.

Shen, et al., "Stresses, Curvatures, and Shape Changes Arising from Patterned Lines on Silicon Wafers", Journal of Applied Physics 80:3, Aug. 1996, pp. 1388-1398.

U.S. Appl. No. 60/702,783, filed Jul. 26, 2005.

* cited by examiner

*Primary Examiner*—Hoon Song
(74) *Attorney, Agent, or Firm*—Smith, Gambrell & Russell, LLP

(57) ABSTRACT

A method for producing X-ray optics includes providing a wafer of crystalline material having front and rear surfaces and a lattice spacing suitable for reflecting incident X-rays of a given wavelength. A thin film is deposited on the front surface of the wafer so as to generate compressive forces in the thin film sufficient to impart a concave curvature to the rear surface of the wafer with at least one radius of curvature selected for focusing the incident X-rays.

15 Claims, 3 Drawing Sheets

CURVED X-RAY REFLECTOR

CROSS-REFERENCE TO RELATED APPLICATION

This application claims the benefit of U.S. Provisional Patent Application 60/702,783, filed Jul. 26, 2005, which is incorporated herein by reference.

FIELD OF THE INVENTION

The present invention relates generally to X-ray optics, and specifically to methods for producing curved X-ray reflectors and devices made by such methods.

BACKGROUND OF THE INVENTION

Doubly-curved crystals are commonly used for focusing monochromatic radiation beams, particularly in the X-ray range, and for wavelength dispersion in X-ray spectrometers. To produce such devices, the crystal curvature must be carefully controlled to give the desired focusing properties. Exemplary methods for forming doubly-curved crystals of this sort are described in U.S. Pat. Nos. 4,807,268, 4,780,899, 4,949,367, 6,236,710 and 6,498,830, whose disclosures are incorporated herein by reference.

When a thin film is deposited on a substrate, compressive or tensile stresses may be created in the film, depending on the conditions of deposition. These stresses cause tensile or compressive internal forces in the substrate/thin film assembly, which may cause bending moments in the assembly. Hoffman et al. studied and reported on these stress phenomena in an article entitled, "Internal Stresses in Cr, Mo, Ta, and Pt Films Deposited by Sputtering from a Planar Magnetron Source," *Journal of Vacuum Science and Technology* 20:3 (March, 1982), pages 355-358, which is incorporated herein by reference. The authors found that when the pressure of argon process gas was below a certain level during sputter-deposition of the films, the stresses tended to be compressive.

Shen et al. described the evolution of stresses and the accompanying changes in overall curvature due to patterning of silicon oxide lines on silicon wafers in an article entitled, "Stresses, Curvatures, and Shape Changes Arising from Patterned Lines on Silicon Wafers," *Journal of Applied Physics* 80:3 (August, 1996), pages 1388-1398, which is incorporated herein by reference. The authors developed a parametric numerical model for the stresses created in $SiO_2$ lines of different dimensions and used the model to predict the curvature caused by these stresses in silicon wafers on which the lines were deposited.

SUMMARY OF THE INVENTION

Embodiments of the present invention provide novel methods for producing optics based on curved crystals. These methods do not require the crystal to be pressed into a mold or bent using an external tool or die. Rather, the crystal is bent to the desired radius (or radii) of curvature by the stresses in a thin film layer deposited on the crystal. The curvature is determined by appropriate selection of the parameters of the deposition process and the geometry and dimensions of the thin film. This approach can be used to produce curved X-ray reflectors (including doubly-curved reflectors) simply and at low cost. The techniques disclosed hereinbelow are applicable to both single-crystal and polycrystalline materials, as well as to amorphous materials.

There is therefore provided, in accordance with an embodiment of the present invention, a method for producing X-ray optics, including:

providing a wafer of crystalline material having front and rear surfaces and a lattice spacing suitable for reflecting incident X-rays of a given wavelength; and depositing a thin film on the front surface of the wafer so as to generate compressive forces in the thin film sufficient to impart a concave curvature to the rear surface of the wafer with at least one radius of curvature selected for focusing the incident X-rays.

In a disclosed embodiment, providing the wafer includes providing a silicon wafer, and depositing the thin film includes depositing a metal film on the wafer. Typically, the metal film includes at least one of tungsten and titanium.

In some embodiments, depositing the thin film includes forming stripes of the thin film on the front surface, the stripes having a thickness, width and spacing selected to create the at least one selected radius of curvature. The thickness, width and spacing of the stripes may be chosen so as to impart to the wafer a first radius of curvature about a first curvature axis and a second radius of curvature, different from the first radius of curvature, about a second curvature axis. In a disclosed embodiment, forming the stripes includes sputtering the thin film onto the front surface and then etching the thin film.

Typically, the method includes thinning the rear surface of the wafer after depositing the thin film, so that the thinned wafer curves to the selected radius of curvature.

There is also provided, in accordance with an embodiment of the present invention, an X-ray optic, including:

a wafer of crystalline material having front and rear surfaces and a lattice spacing suitable for reflecting incident X-rays of a given wavelength; and a thin film deposited on the front surface of the wafer so as to generate compressive forces in the thin film sufficient to impart a concave curvature to the rear surface of the wafer with at least one radius of curvature selected for focusing the incident X-rays.

There is additionally provided, in accordance with an embodiment of the present invention, an X-ray spectrometer, including:

an X-ray source, which is operative to emit a beam of X-rays of a given wavelength;

an X-ray optic, which is configured and positioned to focus the beam of X-rays onto a sample, and which includes:

a wafer of crystalline material having front and rear surfaces and a lattice spacing suitable for reflecting the X-rays of the given wavelength; and a thin film deposited on the front surface of the wafer so as to generate compressive forces in the thin film sufficient to impart a concave curvature to the rear surface of the wafer with at least one radius of curvature selected for focusing the X-ray beam.

The present invention will be more fully understood from the following detailed description of the embodiments thereof, taken together with the drawings in which:

DETAILED DESCRIPTION OF EMBODIMENTS

Figure 1:
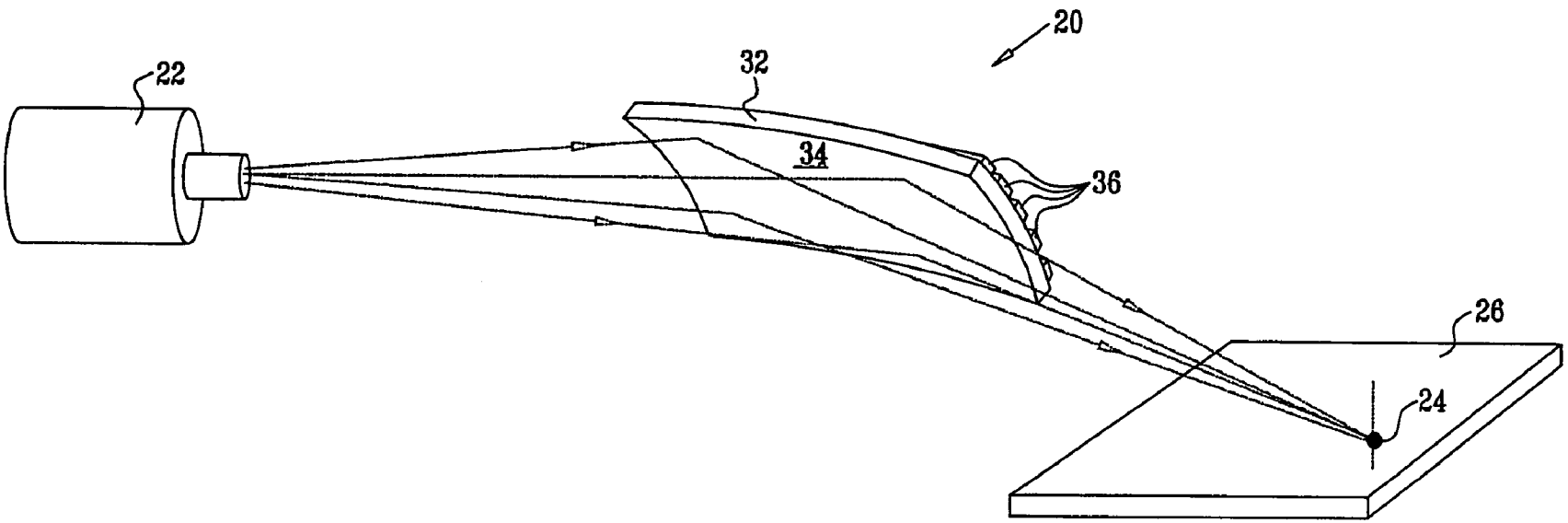
FIG. 1 is a schematic, pictorial illustration of an X-ray reflector, in accordance with an embodiment of the present invention.

FIG. 1 is a schematic, pictorial illustration showing an X-ray reflector 20 used in an X-ray spectrometer, in accordance with an embodiment of the present invention. An X-ray source 22 emits a beam of X-rays, which are incident on reflector 20. The reflector is doubly-curved, and may have different radii of curvature about the X- and Y-axes. (In this example, the X-axis is taken to be the axis that is approximately parallel to the X-ray beam axis, while the Y-axis is transverse to the beam; but these axis designations are arbitrary and are chosen here solely for the sake of convenience.) The curvature and position of reflector 20 are chosen so that the reflector focuses the X-ray beam to a spot 24 on the surface of a sample 26. Alternatively, the reflector may be configured to produce a line focus on the sample. X-rays scattered from sample 26 are received by a detector (not shown), and the spectrum of the scattered X-rays is analyzed to determine properties of the sample, using methods known in the art.

Reflector 20 is fabricated on a crystalline substrate 32, such as a silicon wafer in (111) orientation, which has a certain lattice spacing. As a result of diffraction from this lattice, the X-rays that are incident at spot 24 are monochromatized. In typical applications of reflector 20, X-rays scattered from spot 24 are detected in order to measure properties of sample 26. Alternatively, X-ray optics produced according to the principles of the present invention may be used in substantially any other application that requires curved, reflective X-ray optics.

The desired curvature of reflector 20 is imparted to substrate 32 by deposition of thin film stripes 36 on the front surface of the substrate. The X-rays reflect from a concave rear surface 34 of the substrate. Typically, the rear surface is thinned and polished, as described hereinbelow. Because the remaining substrate material may be very thin—typically on the order of 30-50 μm—the front surface may be mounted on a suitable backing (not shown), which provides mechanical stability without deforming the shape of the reflector.

Figure 2A:
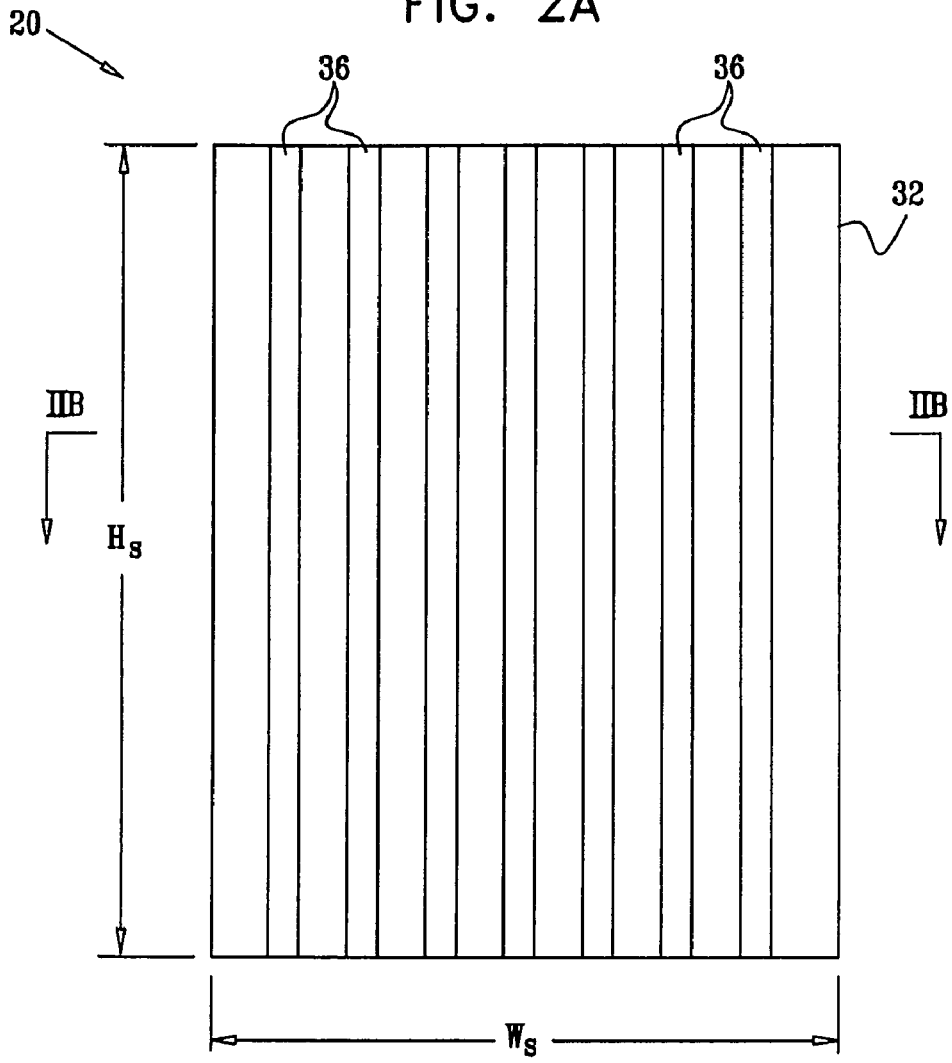
FIG. 2A is a schematic frontal view showing stripes of a thin film formed on a semiconductor wafer, in accordance with an embodiment of the present invention.
Figure 2B:
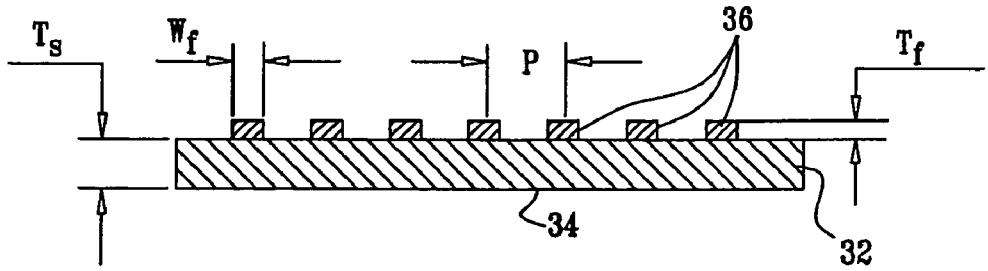
FIG. 2B is a schematic, sectional view of the thin film and wafer shown in FIG. 2A, taken along a line IIB-IIB.

FIGS. 2A and 2B are front and sectional views, respectively of reflector 20, in accordance with an embodiment of the present invention. For the sake of clarity of illustration, the dimensions of substrate 32 and stripes 36 are not drawn to scale. The curvature imparted to the substrate by the compressive stress in stripes 36 is also neglected in this figure.

Substrate 32, which typically comprises a (111) silicon wafer, as noted above, is cut to dimensions $H_S$ by $W_S$, for example 25×15 mm. The substrate, after thinning, has a thickness $T_S$, while stripes 36 have a thickness $T_F$. For a given degree of (compressive) stress σ in stripes 36, the radius of curvature of reflector 20 is determined by the ratio $T_F/T_S^2$, as given by the Stoney formula (cited in the above-mentioned article by Shen et al.) The stress created in stripes 36 is determined by the parameters of the process that is used to create the stripes. For instance, in an exemplary process described below, a tungsten titanium alloy (WTi) is sputtered onto the silicon substrate at low argon pressure so as to create a compressive stress σ of about 1600 MPa in a WTi layer that is 2 μm thick. Depending on the thickness of the WTi layer and other sputter parameters, the stress created may range between a few hundred and over 2000 MPa. Other materials, such as Ti alone, may be used in place of WTi and will give different stress parameters.

The WTi (or other thin film material) is etched in a pattern of uniform stripes having width $W_F$ and pitch P. When the stripes are parallel to the X-axis, as shown in the figure, the bending moment exerted by the stripes on the substrate is generally greater along the X-axis than along the Y-axis. As a result, the radius of curvature of reflector 20 about the Y-axis, $R_Y$, will be larger than the radius of curvature about the X-axis, $R_X$. The width and pitch of the stripes are selected so as to give the desired relation between the X- and Y-radii of curvature. Shen et al. describe a mathematical model that may be used for this purpose. For example, taking $T_F$~2 μm, $T_S$~50 μm, and σ~-1600 MPa, with $W_F$~13.6 μm and P~27.2 μm, it is expected that $R_Y$ will be approximately 815 mm, while $R_X$ will be approximately 50 mm.

The foregoing values, however, are only rough approximations, and some trial and error may be required to arrive at the exact radii of curvature that are desired. Furthermore, although stripes 36 create a pattern that is easy to design and to model mathematically, the thin film layer that is used to create the curvature of reflector 20 may be etched or otherwise formed in any suitable pattern. The pattern may be symmetrical or non-symmetrical, depending on the desired shape of the reflector. Furthermore, if a rotationally-symmetrical reflector ($R_X$×$R_Y$) is desired, then a uniform thin film may be used, without any pattern.

Figure 3:
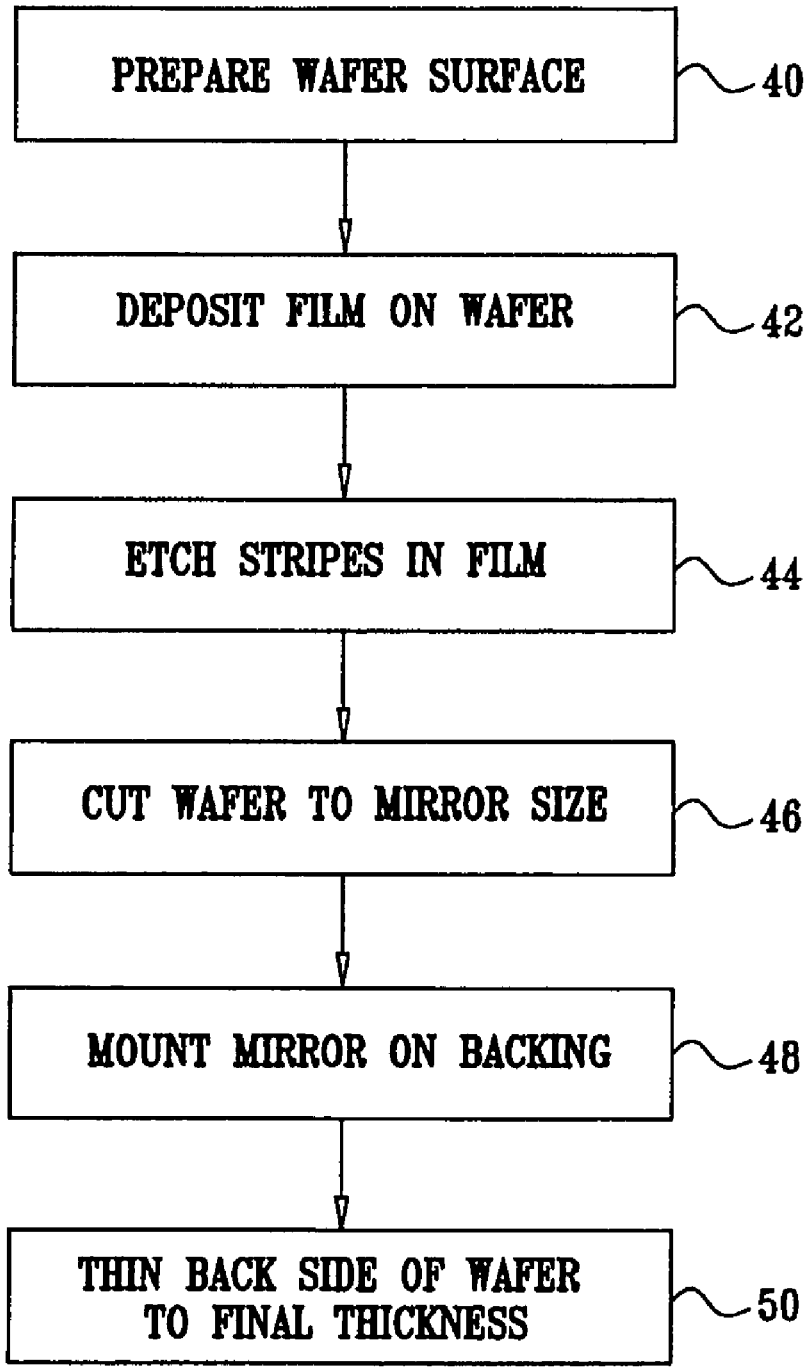
FIG. 3 is a flow chart that schematically illustrates a method for producing a curved X-ray optic, in accordance with an embodiment of the present invention.

FIG. 3 is a flow chart that schematically illustrates a method for producing a curved X-ray reflector, such as reflector 20, in accordance with an embodiment of the present invention. For convenience in handling, the process begins with a conventional silicon wafer, such as a standard 8" wafer, which is typically about 600 μm thick. The wafer is inserted into the processing chamber of a suitable sputtering machine, such as the Unaxis LLS EVO (produced by Oerlikon Balzers Ltd., Liechtenstein). The chamber is pumped down to a high vacuum, typically less than $10^{-6}$ mbar, and the wafer surface is prepared for sputtering, at a surface preparation step 40. For example, the chamber may be filled with low-pressure argon, to about $1.8\times10^{-3}$ mbar, with a flow rate of 35 sccm (standard cubic centimeters per minute), and a DC current may be applied to a WTi sputtering target in the chamber for a brief period. The sputtering target used in the process may comprise, for example, an alloy of tungsten and titanium in a 90/10 ratio, bonded onto a copper base. In one experiment, a DC current at about 5 kW of power was applied to the WTi target for a period of 90 sec in order to "presputter" the wafer.

Next, a thin film is deposited onto the wafer in the processing chamber, at a deposition step 42. During this step, the argon pressure in the chamber is kept low, typically on the order of $1\text{-}2\times10^{-3}$ mbar, so that compressive stress will be generated in the thin film layer. A DC power level is applied to the sputtering target for a longer period (and possibly at a higher power) than in the preceding stage. For example, in one experiment, a DC power of 5 kW was applied to the WTi target for about 84 min during step 42 in order to deposit a 2 μm WTi layer on the wafer. The duration of this step may be adjusted to give the desired film thickness. In order to reach a large layer thickness, it may be desirable in some cases to use pulsed sputtering, as is known in the art. The result of step 42 is that a uniform, compressively-stressed layer of coating material, such as WTi, is deposited over the entire front surface of the wafer.

In order to create stripes 36, the coating layer is etched in the desired pattern, at an etching step 44. To etch a thick WTi layer of the sort described above, for example, reactive ion etching may be used. The wafer is then cut to the desired dimensions of reflector 20 ($H_s$×$W_S$), at a cutting step 46.

Alternatively, the wafer may be cut to the desired dimensions before stripes 36 are created on the wafer surface.

At this point, the reflector is still substantially planar, since the thickness of the wafer substrate is so much greater than that of stripes 36. In order to achieve the desired curvature, it is necessary to thin the wafer substantially. Before doing so, however, it is desirable to mount the reflector on a suitable backing, at a mounting step 48. For this purpose, the front surface of the reflector (i.e., the surface on which stripes 36 are formed) is attached to a suitable backing. The attachment is made in such a way as to prevent the reflector from bending freely under the stress in stripes 36 while the substrate is thinned. Furthermore, the wafer may be cut very thin initially or may undergo a thinning process even before stripes 36 are created on the wafer.

The back side of substrate 32 is thinned to the desired thickness (30-50 μm in the example above), at a thinning step 50. After the substrate is thinned and released from the backing, it bends to the desired radii of curvature. Various methods are known in the art for backside-thinning of silicon substrates, and any suitable method may be used at step 50. For example, chemical-mechanical polishing (CMP) may be used to reduce the wafer thickness to about 200 μm, followed by deep reactive ion etching (DRIE) down to the target thickness. Typically, as a result of the thinning step, the back surface of the substrate is smoothed sufficiently to serve as an efficient X-ray reflector.

The specific method and process parameters described above are presented solely by way of example, and other methods and processes for creating curved crystal optics based on stresses in films deposited on a substrate are also considered to be within the scope of the present invention. Although the embodiment described above relates to production of an X-ray mirror from a single-crystal substrate, the principles of the present invention may similarly be applied in creating curved optics for other spectral ranges. These optics may be produced not only from a single-crystal substrate, but also from polycrystalline and amorphous materials. It will thus be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method for producing X-ray optics, comprising:

providing a wafer of crystalline material having front and rear surfaces and a lattice spacing suitable for reflecting incident X-rays of a given wavelength; and depositing a thin film on the front surface of the wafer so as to generate compressive forces in the thin film sufficient to impart a concave curvature to the rear surface of the wafer with at least one radius of curvature selected for focusing the incident X-rays.

2. The method according to claim 1, wherein providing the wafer comprises providing a silicon wafer, and wherein depositing the thin film comprises depositing a metal film on the wafer.

3. The method according to claim 2, wherein the metal film comprises at least one of tungsten and titanium.

4. The method according to claim 1, wherein depositing the thin film comprises forming stripes of the thin film on the front surface, the stripes having a thickness, width and spacing selected to create the at least one selected radius of curvature.

5. The method according to claim 4, wherein the thickness, width and spacing of the stripes are chosen so as to impart to the wafer a first radius of curvature about a first curvature axis and a second radius of curvature, different from the first radius of curvature, about a second curvature axis.

6. The method according to claim 4, wherein forming the stripes comprises sputtering the thin film onto the front surface and then etching the thin film.

7. The method according to claim 1, and comprising thinning the rear surface of the wafer after depositing the thin film, so that the thinned wafer curves to the selected radius of curvature.

8. An X-ray optic, comprising:

a wafer of crystalline material having front and rear surfaces and a lattice spacing suitable for reflecting incident X-rays of a given wavelength; and a thin film deposited on the front surface of the wafer, having compressive forces in the thin film sufficient to impart a concave curvature to the rear surface of the wafer with at least one radius of curvature selected for focusing the incident X-rays.

9. The optic according to claim 8, wherein the wafer comprises silicon, and wherein the thin film comprises a metal.

10. The optic according to claim 9, wherein the metal film comprises at least one of tungsten and titanium.

11. The optic according to claim 8, wherein the thin film comprises stripes of the thin film, the stripes having a thickness, width and spacing selected to create the at least one selected radius of curvature.

12. The optic according to claim 11, wherein the thickness, width and spacing of the stripes are chosen so as to impart to the wafer a first radius of curvature about a first curvature axis and a second radius of curvature, different from the first radius of curvature, about a second curvature axis.

13. The optic according to claim 11, wherein the stripes are formed by sputtering the thin film onto the front surface and then etching the thin film.

14. The optic according to claim 8, wherein the rear surface of the wafer is thinned after depositing the thin film, so that the thinned wafer curves to the selected radius of curvature.

15. An X-ray spectrometer, comprising:

an X-ray source, which is operative to emit a beam of X-rays of a given wavelength;

an X-ray optic, which is configured and positioned to focus the beam of X-rays onto a sample, and which comprises:

a wafer of crystalline material having front and rear surfaces and a lattice spacing suitable for reflecting the X-rays of the given wavelength; and a thin film deposited on the front surface of the wafer, having compressive forces in the thin film sufficient to impart a concave curvature to the rear surface of the wafer with at least one radius of curvature selected for focusing the X-ray beam.

* * * * *